US009785179B2

(12) United States Patent
Koerner

(10) Patent No.: US 9,785,179 B2
(45) Date of Patent: Oct. 10, 2017

(54) GENERATING A CURRENT WITH INVERSE SUPPLY VOLTAGE PROPORTIONALITY

(71) Applicant: Infineon Technologies AG, Neubiberg (DE)

(72) Inventor: Heiko Koerner, Soeding (AT)

(73) Assignee: Infineon Technologies AG, Neubiberg (DE)

( * ) Notice: Subject to any disclaimer, the term of this patent is extended or adjusted under 35 U.S.C. 154(b) by 2 days.

(21) Appl. No.: 14/843,985

(22) Filed: Sep. 2, 2015

(65) Prior Publication Data

US 2016/0062385 A1 Mar. 3, 2016

(30) Foreign Application Priority Data

Sep. 2, 2014 (DE) ..... 10 2014 013 032

(51) Int. Cl.
*G05F 3/26* (2006.01)
*G05F 3/24* (2006.01)

(52) U.S. Cl.
CPC ..... *G05F 3/262* (2013.01); *G05F 3/26* (2013.01); *G05F 3/24* (2013.01)

(58) Field of Classification Search
CPC ..... G05F 3/24; G05F 3/26; G05F 3/262
USPC ..... 323/312–317
See application file for complete search history.

(56) References Cited

U.S. PATENT DOCUMENTS 6,150,872 A * 11/2000 McNeill ..... G05F 3/30 323/313
6,492,795 B2 12/2002 Engl
7,301,321 B1 * 11/2007 Uang ..... G05F 3/262 323/313
7,479,775 B2 * 1/2009 Hsu ..... H02M 3/073 313/313
7,626,374 B2 * 12/2009 Haiplik ..... G05F 3/30 323/313
7,852,061 B2 * 12/2010 Liu ..... G05F 3/30 323/313
7,944,194 B2 * 5/2011 Huang ..... G05F 1/561 323/313
8,040,123 B2 * 10/2011 Yanagawa ..... G05F 3/30 323/313
8,294,449 B2 * 10/2012 Ide ..... G05F 3/30 323/314

(Continued)

FOREIGN PATENT DOCUMENTS

DE 10042586 A1 3/2002

*Primary Examiner* — Kyle J Moody
(74) *Attorney, Agent, or Firm* — Shumaker & Sieffert, P.A.

(57) ABSTRACT

A reference current generating circuit may comprise a first transistor with a gate, a source and a drain and a second transistor with a gate, a source and a drain. The source of the first transistor and the source of the second transistor are connected to one another and the width-to-length ratios of the first and the second transistors are equal. A differential amplifier has two voltage inputs, of which the first is at a reference potential while the second is connected to a first node coupled to the drain of the first transistor. A reference current generating circuit is designed such that the drain-source voltage of the second transistor is greater in amount than the drain-source voltage of the first transistor. An output circuit is set up to output a reference current based on the current through the second transistor.

13 Claims, 2 Drawing Sheets

(56) References Cited

U.S. PATENT DOCUMENTS

| | | | | |
|---|---|---|---|---|
| 8,547,079 | B2 * | 10/2013 | Socheat | G05F 1/575 323/275 |
| 8,674,671 | B2 * | 3/2014 | Hikichi | G05F 1/575 323/274 |
| 9,395,731 | B2 * | 7/2016 | Bhattad | G05F 1/56 |
| 2008/0265853 | A1 * | 10/2008 | Chen | G05F 1/571 323/280 |
| 2013/0278331 | A1 | 10/2013 | Kamiya | |
| 2015/0205319 | A1 * | 7/2015 | De Cremoux | H02M 3/18 331/109 |
| 2015/0370280 | A1 * | 12/2015 | Ryabchenkov | |
| 2016/0274614 | A1 * | 9/2016 | Tang | G05F 3/262 |

* cited by examiner

GENERATING A CURRENT WITH INVERSE SUPPLY VOLTAGE PROPORTIONALITY

BACKGROUND

The described embodiments relate to generating a current with inverse supply voltage proportionality. Many electrical circuits require reference currents, of an amount with properties that meet the requirements for the circuit. For many integrated circuits it is necessary to generate a bias current, which keeps the circuit at a certain desired operating point. A current that is independent of the supply voltage, that is to say is constant, is often generated in this case.

What is disadvantageous in the case of such circuits is that, in the case of a falling supply voltage, the generated bias currents drop, or drop sharply at the lower end of the operating range. This is firstly due to the output conductances of the corresponding circuits, which cannot be infinite, and secondly due to the limited biasing controllability of such circuits.

SUMMARY

One embodiment of the application concerns a reference current generating circuit which comprises a first transistor with a gate, a source and a drain and a second transistor with a gate, a source and a drain, wherein the source of the first transistor and the source of the second transistor are connected to one another and the width-to-length ratios of the first transistor and the second transistor are identical. In addition, the reference current generating circuit comprises a differential amplifier with two voltage inputs, of which the first voltage input is at a reference voltage potential, while the second voltage input is connected to a first node, which is coupled to the drain of the first transistor, wherein the gate of the second transistor and the gate of the second transistor are connected to the first output of the differential amplifier and the reference current generating circuit is designed such that the drain-source voltage of the second transistor is greater in amount than the drain-source voltage of the first transistor. Also provided is an output circuit for outputting a reference current on the basis of the current through the source-drain path of the second transistor.

DETAILED DESCRIPTION

Figure 1:
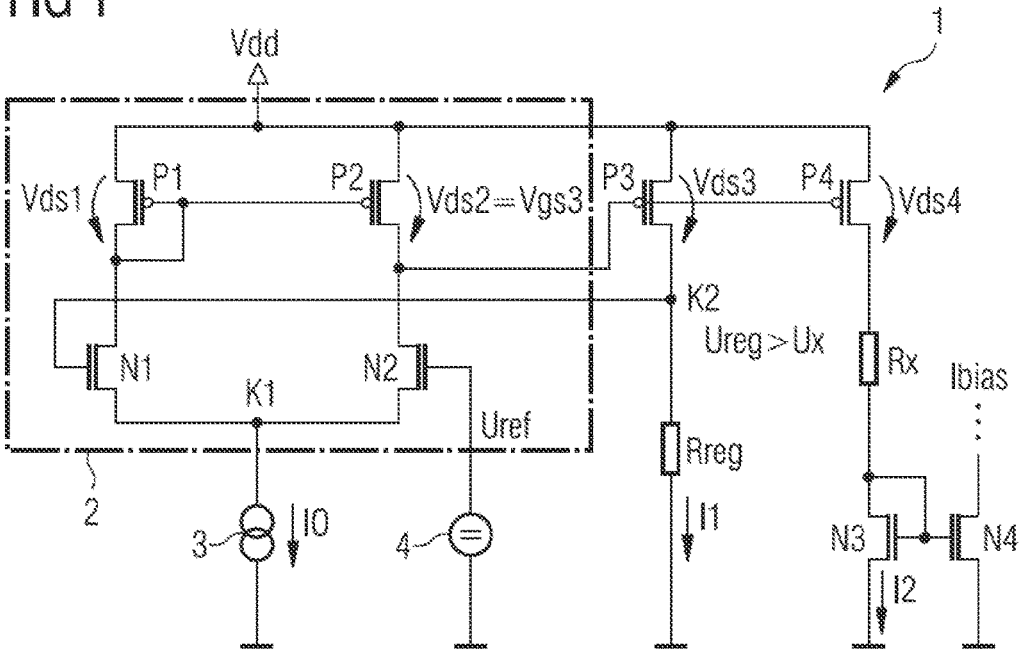
FIG. 1 shows an embodiment of a circuit according to the invention.

FIG. 1 shows a diagram of a circuit 1 for generating a reference current. The circuit 1 comprises a differential amplifier 2, a constant current source 3, a reference voltage source 4, a first transistor P3, a second transistor P4, a first load path resistor Rreg, a second load path resistor Rx, a first output mirror transistor N3 and a second output mirror transistor N4. The differential amplifier 2 has a first differential amplifier transistor N1, a second differential amplifier transistor N2, a first mirror transistor P1 and a second mirror transistor P2. The constant current source 3 is connected by one terminal to ground, while a second terminal is connected to a node K1, to which the sources of the first and second differential amplifier transistors N1 and N2, which are designed as NMOS transistors, are also connected.

The drain of the first differential amplifier transistor N1 is connected to the drain of the first mirror transistor P1, which is designed as a PMOS transistor. The drain of the second differential amplifier transistor N2 is connected to the drain of the second mirror transistor P2, which is designed as a PMOS transistor. The gate of the first mirror transistor P1 is connected to the drain of this first mirror transistor P1 and to the gate of the second mirror transistor P2. The source of the first mirror transistor P1 and the source of the second mirror transistor P2 are connected to the voltage supply node Vdd.

Also connected to this node Vdd are the sources of the first and second transistors P3 and P4, which are respectively designed as PMOS transistors. The drain of the first transistor P3 is connected to the gate of the first differential amplifier transistor N1, while the gate of the first transistor P3 is connected to the drain of the second differential amplifier transistor N2. The gate of the second differential amplifier transistor N2 is connected to one terminal of the reference voltage source 4, the second terminal of which is connected to ground.

The node K2 is connected to the drain of the first transistor P3 and to a first terminal of the first load path resistor Rreg. The potential that is present at the node K2 is referred to as UReg. The gate of the second transistor P4 is connected to the gate of the first transistor P3. The drain of the second transistor P4 is connected to a first terminal of the second load path resistor Rx, the second terminal of which is connected to the drain of the first output mirror transistor N3. The source of the first output mirror transistor N3 is connected to the source of the second output mirror transistor N4. Moreover, the gates of the first output mirror transistor N3 and of the second output mirror transistor N4 are connected. These gates are also connected to the drain of the first output mirror transistor N3. The current that flows through the source of the drain load path of the second output mirror transistor N4 is referred to as Ibias. The current through the first load path resistor Rreg is referred to as I1. The current through the second load path resistor Rx is referred to as I2.

The constant current source 3 generates a current I0, which is as constant as possible with varying temperature and supply voltage. Such a current may be generated for example with the aid of a band spacing reference source. The current I0 is divided into two partial currents, of which the first flows through the source-drain load paths of the transistors N1 and P2 and the second flows through the source-drain load paths of the transistors N2 and P2. Transistors P1 and P2 are provided in a current mirror, so that the ratio of the currents through their load paths corresponds to the ratio of the width-length ratios of the gates. If, for example, the width and the length of the gate of the transistor P2 are identical to the width and the length of the gate of the transistor P1, currents of an equal magnitude also flow through the source-drain load paths of the transistors P1 and P2. However, it is pointed out that there are also embodiments in which the sizes of the gates and the magnitudes of the currents through the load paths of P1 and P2 differ.

In one embodiment, the gates of the transistors of N1 and N2 are of the same size. The gate of the second differential amplifier transistor N2 is at a potential provided by the reference voltage source 4. The reference voltage source 4, for example a band spacing reference source, provides a voltage that is as independent as possible of the temperature and the supply voltage. Together with the first transistor P3 and the first load path resistor Rreg, the differential amplifier 2 forms a control loop. The manipulated variable is the current I1, which on the basis of the arrangement of the control loop becomes so great that Ureg is equal to the potential Uref. In this case, the same current flows through the differential amplifier transistors N1 and N2, which is dictated by the transistors P1 and P2. In other words, the ratio of the currents through P1 and P2, and consequently through N1 and N2, provides that the potential Ureg at the gate of the first transistor P3 is controlled so as to be equal to the potential Uref. Should the potential Ureg be higher than Uref, the transistor N1 will be biased further into conduction. Consequently, the potential at the drain of P1 would become lower, which would increase the current through P1 and consequently P2. The potential at the drain of the transistor P2 would consequently also become lower, so that P3 is biased less into conduction. The potential at K2 consequently falls again. In the converse case where Ureg is too low, the control would provide that P3 is biased further into conduction, so that Ureg increases again.

The source and the gate of the first transistor P1 are respectively connected to the source and the gate of the second transistor P2. Since, however, the potentials at the drains are different, the ratio of the currents differs from the ratio of the width-to-length ratios of the transistors P2 and P3. Let us assume that in this embodiment the width-to-length ratios of the transistors P3 and P4 are equal. In this case, the current through the source of the drain load path would have to be identical if the potentials at the drains were identical. Since the potential Ux at the drain of the second transistor P4 is less than the potential Ureg, somewhat more current flows through P4 than through P3 if both transistors are operated in the saturation range. The potential Ux is obtained from the drain-source voltage of the first output mirror transistor N3 plus the voltage across the second load path resistor Rx. Both influencing parameters depend on the current I2 through the load path of the second transistor P4.

On account of the current mirror arrangement, the current I2 determines the current Ibias through the second output mirror transistor N4. This current Ibias can be used in subsequent stages as a reference current.

The current I2 is produced by way of the additional transistor P4, or the reference current Ibias is produced by coupling out by way of N3. In comparison with solutions that use the cascode technique to generate a mirror ratio that is as constant as possible, a slightly negative course of the current I2 with varying supply voltage Vdd is produced with the circuit from FIG. 1. Consequently, the current increases with a falling supply voltage potential Vdd. If, finally, the transistors P3 and P4 leave the saturation range, there is a disproportionate increase in the current I2 at the output. In order to influence correspondingly this profile of the current I2, or as a consequence the current Ibias, there is the second load path resistor Rx additionally in the current path of I2. With this resistor Rx, the drain-source voltage of the second transistor P4 is set, to be precise with respect to the voltage Ureg. A fundamentally different profile of the reference current Ibias is produced as a result of the potential Ux then generated lying below Ureg.

Figure 2:
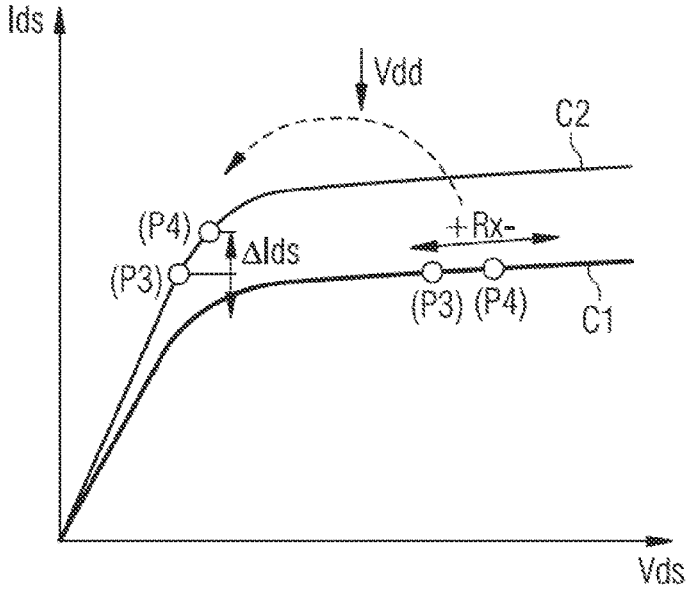
FIG. 2 shows profiles of currents in the circuit as shown in FIG. 1.

FIG. 2 shows the profiles of the load current Ids through the source-drain paths of the transistors P3 and P4 on the basis of the drain-source voltage with reference to two curves C1 and C2, the curves C1 and C2 differing by their respective gate-source voltage. In the case of the curve C1, both transistors are in the saturation range, and consequently in the flattened part of the curve C1. Since the drain-source voltage of the second transistor P4 is greater than the drain-source voltage of the first transistor P3, the current through the second transistor P4 is somewhat greater than the current through the first transistor P1. The point identified by P3 indicates the current I1 and the point identified by P4 indicates the current I2. The arrow above the curve C1 indicates that the distance between the points identified by P3 and P4 can be set with the aid of the resistor Rx.

The curve C2 shows the profile of the current Ids in the case where the supply voltage potential Vdd has fallen—in comparison with the case represented by the curve C1—so that, because of the reduced gate-source voltage, the transistors P3 and P4 are in the linear range or in the transitional range between the linear range and the saturation range. When reference is made to a small or low voltage or a high or great voltage, this means in each case the amount of the voltage, irrespective of whether it is positive or negative.

Since the curve C2 is steeper in the region in which the points P3 and P4 are located than in the corresponding region of the curve C1, the difference in the currents through the source-drain load paths between the points P3 and P4 is greater on the curve C2 than on the curve C1. This means that the difference between I2 and I1 increases with a reduced supply voltage. In this case the current I2 also increases with a reduced supply voltage. The current I2 is mirrored in the reference current Ibias, so that the current I2 also has said profile, so that the reference current Ibias increases with a reduced supply voltage.

There are electrical circuits in which it is more favorable to use reference currents that increase with a falling supply voltage. In the case of such circuits, one parameter that would actually drop as a result of the falling supply voltage, for example a gain, can be kept constant, because the increasing reference current has an influence on the parameter that is opposite to that of the falling supply voltage. For some of these circuits, however, it is also sufficient that the reference current only has a profile that is inversely proportional to the supply voltage in certain ranges of the supply voltage.

Figure 3:
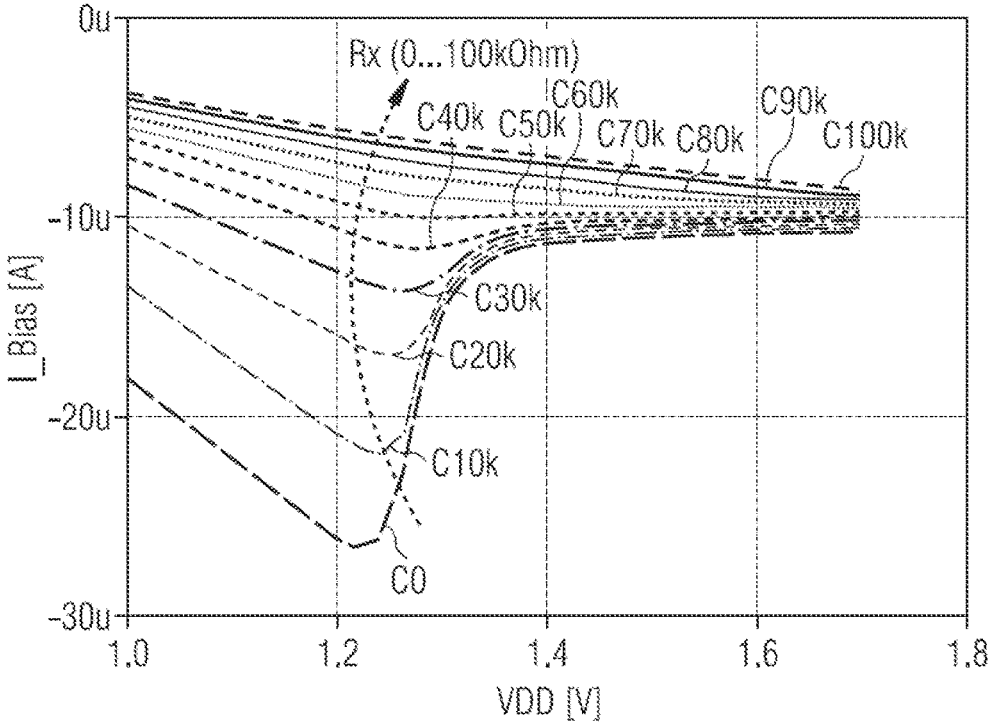
FIG. 3 shows profiles of currents in the circuit as shown in FIG. 1 on the basis of a resistance value.

FIG. 3 shows results of a circuit simulation of the circuit that is shown in FIG. 1. FIG. 3 shows the simulation results for the reference current in amperes on the basis of the supply voltage potential Vdd in volts, it being assumed that ground is at of potential of 0 V. The voltage was simulated in a range between 1.8 and 1 V, that is to say in the range that can be referred to as the undervoltage range, since the circuits are at the limit of operability. FIG. 3 shows the simulation results for eleven different circuits, the circuits differing by the resistance value of the second load path resistor. The second load path resistor was in this case varied between 0 ohm and 100 kohms, the simulated results being indicated by curves that are identified by C with a subsequent resistance value in ohms. The curve C40*k* for example indicates the profile of the reference current Ibias on the basis of the supply voltage potential Vdd, the resistance value of the second load path resistor Rx being forty kiloohms. The current Ibias remains virtually constant at 10 microamperes in the range between 1.7 V and 1.45 V. If Vdd falls again, the reference current Ibias increases to approximately 11.4 microamperes, after which it drops again as the supply voltage potential Vdd continues to fall below 1.28 V.

The curve C40*k* consequently has a desired profile, such that the current increases with falling supply voltage, at least in one voltage range. It is also desired in this case that the current does not increase too much, but instead that the maximum of the current is limited. In this case it is desired that the maximum of the current is no greater than 1.2 times the current at the high supply voltage.

This generates a drain-source voltage of the second transistor P4 that is greater than that of the first transistor P3, as represented in the diagram in FIG. 3. It can be seen in this diagram how the operating points shift when there is a reduction in the supply voltage Vdd. The drop in voltage at Rx thus also has the effect that there is a desired current limitation, so that the bias current does not exceed the corresponding limit.

How the bias current behaves with varying supply voltage Vdd is consequently represented in FIG. 3. A circuit with a reference voltage of 1.21 V and generation of a bias current of 10 μA was simulated. By variation of the resistance value of the second load path resistor Rx, different curve profiles are obtained, from falling monotonously to rising and then falling. The case aimed for, with an increasing bias current and limitation thereof to +20%, is reproduced by the curve C40*k*. For this, a resistor Rx of 40 kohms should be chosen. With a drop of the Vdd voltage to 1.1 V, the bias current is reduced by a maximum of 20%.

Figure 4:
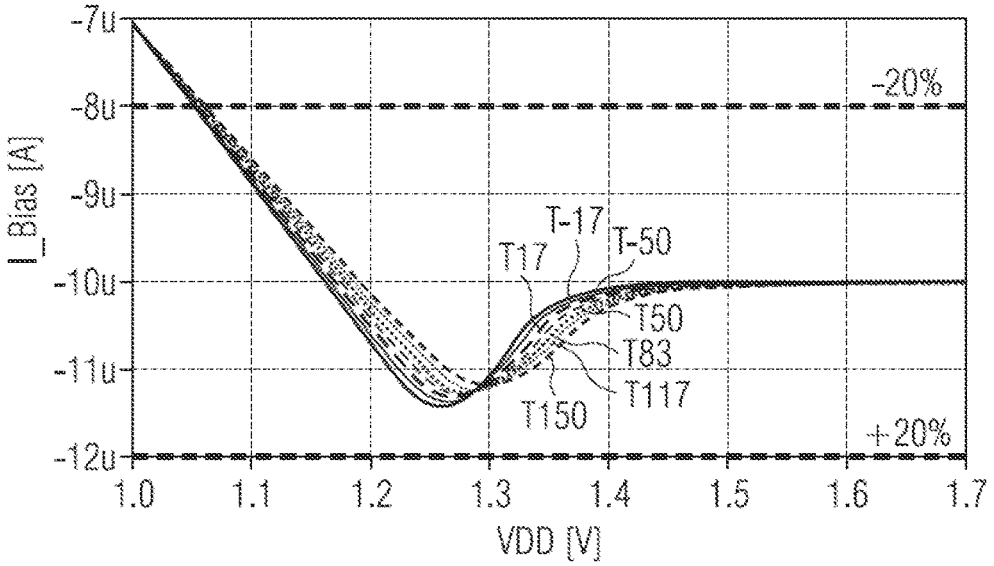
FIG. 4 shows profiles of currents in the circuit as shown in FIG. 1 on the basis of the temperature.

Like FIG. 3, FIG. 4 shows the reference current Ibias in amperes on the basis of the supply voltage potential in volts. By contrast with FIG. 3, however, the resistance value of the second load path resistor Rx is left constantly at 40 kilo-ohms, and instead the temperature is changed. The curves are respectively indicated as T with a subsequent indication of the temperature in Celsius. The lowest temperature is in this case −50 degrees Celsius, the highest 150 degrees Celsius. It is shown that, even with varying temperature, the maximum of the reference current Ibias remains less than 12 microamperes.

With a resistance of 40 k ohms and temperature-based simulation, the result as shown in FIG. 4 is obtained. In it there can be seen the limited bias current that is ensured even with a small supply voltage. Thus, the supply voltage can even lie below the reference voltage (1.21 V).

The invention claimed is:

1. A reference current generating circuit, comprising:

a first transistor with a gate, a source and a drain, a second transistor with a gate, a source and a drain, wherein the source of the first transistor and the source of the second transistor are connected to one another and a width-to-length ratios of the first transistor and the second transistor are equal, a differential amplifier with two voltage inputs, of which a first voltage input is at a reference potential while a second voltage input is connected to a first node, which is coupled to the drain of the first transistor, wherein the gate of the first transistor and the gate of the second transistor are connected to a first output of the differential amplifier, and wherein the reference current generating circuit is designed such that a drain-source voltage of the second transistor is greater in amount than a drain-source voltage of the first transistor, an output circuit for outputting a reference current on a basis of a current through the source-drain path of the second transistor, wherein a magnitude of the reference current, in an event of an undervoltage, is limited to a fraction of the reference current in a state in which both the first transistor and the second transistor are in saturation.

2. The reference current generating circuit as claimed in claim 1, further comprising a first load path resistor for conducting a current through the first transistor in a direction of a supply voltage potential.

3. The reference current generating circuit as claimed in claim 2, further comprising a first output mirror transistor and a second load path resistor, wherein the source and the gate of the first output mirror transistor are connected to one another and load paths of the first output mirror transistor, of the second load path resistor and the load path of the second transistor are connected in series.

4. The reference current generating circuit as claimed in claim 3, wherein the reference current generating circuit is designed such that, in an event of an undervoltage, the magnitude of the reference current is not greater in amount than 1.2 times the reference current in a state in which both the first transistor and the second transistor are in saturation.

5. The reference current generating circuit as claimed in claim 2, wherein the reference current generating circuit is designed such that, in an event of an undervoltage, the magnitude of the reference current is not greater in amount than 1.2 times the reference current in a state in which both the first transistor and the second transistor are in saturation.

6. The reference current generating circuit as claimed in claim 1, further comprising a first output mirror transistor and a second load path resistor, wherein a source and a gate of the first output mirror transistor are connected to one another and load paths of the first output mirror transistor, of the second load path resistor and the load path of the second transistor are connected in series.

7. The reference current generating circuit as claimed in claim 6, further comprising a second output mirror transistor, which mirrors a current through the load path of the first output mirror transistor.

8. The reference current generating circuit as claimed in claim 6, wherein the magnitude of the reference current generating circuit is designed such that, in an event of an undervoltage, the reference current is not greater in amount than 1.2 times the reference current in a state in which both the first transistor and the second transistor are in saturation.

9. The reference current generating circuit as claimed in claim 1, wherein the reference current generating circuit is designed such that, in an event of an undervoltage, the magnitude of the reference current is not greater in amount than 1.2 times the reference current in a state in which both the first transistor and the second transistor are in saturation.

10. A reference current generating circuit, comprising:

a first transistor with a gate, a source and a drain, a second transistor with a gate, a source and a drain, wherein the source of the first transistor and the source of the second transistor are connected to one another and a width-to-length ratios of the first transistor and the second transistor are equal, a differential amplifier with two voltage inputs, of which a first voltage input is at a reference potential while a second voltage input is connected to a first node, which is coupled to the drain of the first transistor, wherein the gate of the first transistor and the gate of the second transistor are connected to a first output of the differential amplifier, a first output mirror transistor and a second load path resistor, wherein a drain and a gate of the first output mirror transistor are connected to one another and load paths of the second transistor, of the second load path resistor and a load path of the first output mirror transistor are connected in series, and wherein the reference current generating circuit is designed such that a drain-source voltage of the second transistor is greater in amount than a drain-source voltage of the first transistor, an output circuit for outputting a reference current on a basis of a current through a source-drain path of the second transistor, wherein a magnitude of the reference current, in an event of an undervoltage, is limited to a fraction of the reference current in a state in which both the first transistor and the second transistor are in saturation.

11. The reference current generating circuit as claimed in claim 10, further comprising a first load path resistor for conducting a current through the first transistor in a direction of a supply voltage potential.

12. The reference current generating circuit as claimed in claim 11, further comprising a second output mirror transistor, which mirrors a current through the load path of the first output mirror transistor.

13. The reference current generating circuit as claimed claim 10, wherein the reference current generating circuit is designed such that, in an event of an undervoltage, the magnitude of the reference current is not greater in amount than 1.2 times the reference current in the state in which both the first transistor and the second transistor are in saturation.

* * * * *